US007803028B2

(12) United States Patent
Melius

(10) Patent No.: US 7,803,028 B2
(45) Date of Patent: Sep. 28, 2010

(54) MULTI-USE ADJUSTABLE BELLOWS-SHAPED APERTURE STRAP

(76) Inventor: John Melius, 2725 Vista Ct., Waldorf, MD (US) 20603

( * ) Notice: Subject to any disclaimer, the term of this patent is extended or adjusted under 35 U.S.C. 154(b) by 144 days.

(21) Appl. No.: 12/289,715

(22) Filed: Nov. 3, 2008

(65) Prior Publication Data

US 2009/0137166 A1 May 28, 2009

Related U.S. Application Data

(60) Provisional application No. 60/996,560, filed on Nov. 26, 2007.

(51) Int. Cl.
*A63B 31/08* (2006.01)

(52) U.S. Cl. ..... 441/64

(58) Field of Classification Search ..... 441/64; 24/68 SK; 36/58.6
See application file for complete search history.

(56) References Cited

U.S. PATENT DOCUMENTS 4,918,753 A * 4/1990 Mermillod ..... 2/10
5,533,213 A * 7/1996 Reiner et al. ..... 2/195.2
5,666,700 A * 9/1997 Anscher et al. ..... 24/163 R
5,771,499 A * 6/1998 Monaco et al. ..... 2/428
5,777,263 A * 7/1998 Maehler et al. ..... 174/51
5,915,534 A * 6/1999 May ..... 2/181.4
6,923,697 B1 8/2005 Wagner

* cited by examiner

*Primary Examiner*—Stephen Avila

(57) ABSTRACT

A strap with tapered-apertures for open-heeled swim fins is stretched from a first end connection to a conventional boss-button and boss-post structure, whereby the strap will apply a desired level of force as a holding-pressure against the heel of a swimmer. The strap's tapered-apertures are cast to link the tapered dimensions of aperture walls to an easy passage of the strap over the boss button and to a highly resistant passage of the strap-top to a designed seat against the top's raised arches. The manufactured formation of the unique aperture shapes result in an unexpected elasticity of the strap. The combination of aperture structure within the raised arches guide the orifice walls of the aperture into compression, instead of tension, greatly resisting forces to release the strap from the boss-posts and buttons.

20 Claims, 3 Drawing Sheets

3
4
6
12
14
14
13
6
16
15
8
4
16
2
10

18
28
28
32
30
29
24

20
22
22
16
14
12
10
13
15
26
24
31
10
16
32
33
26

36
12
30
14
16
38

37
32
31
33
10
40

FIG 4
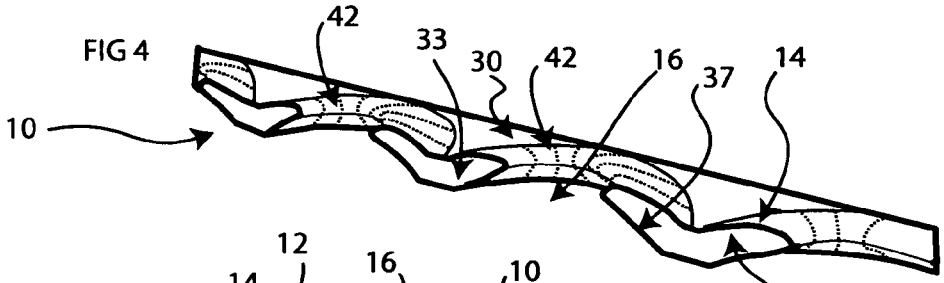
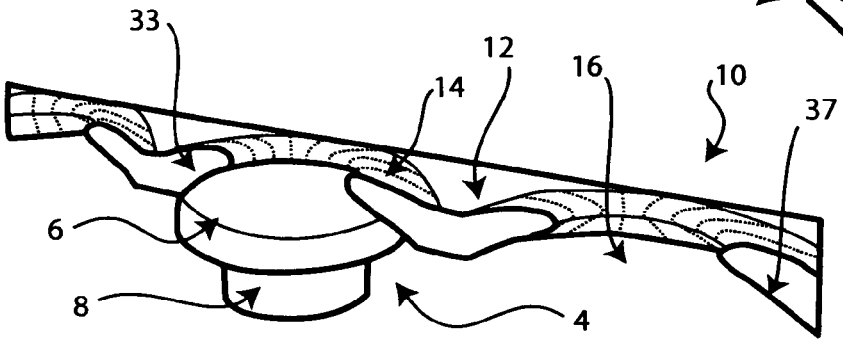
FIG 5
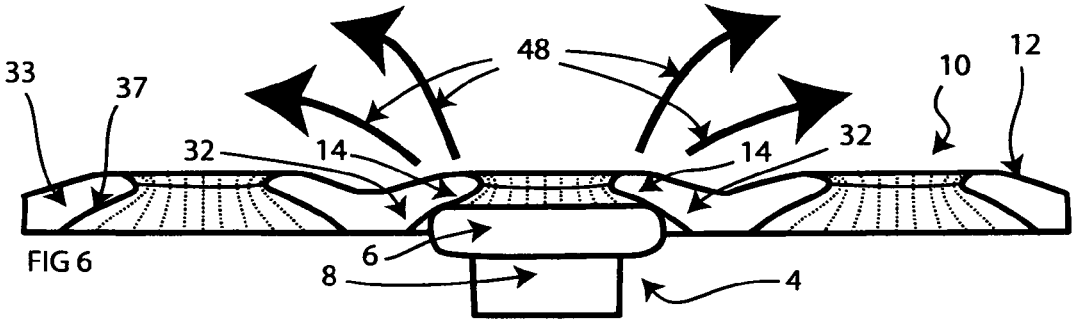
FIG 6
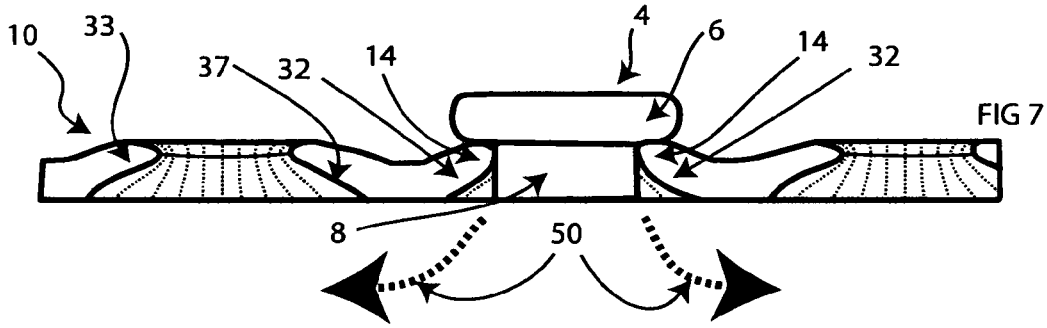
FIG 7
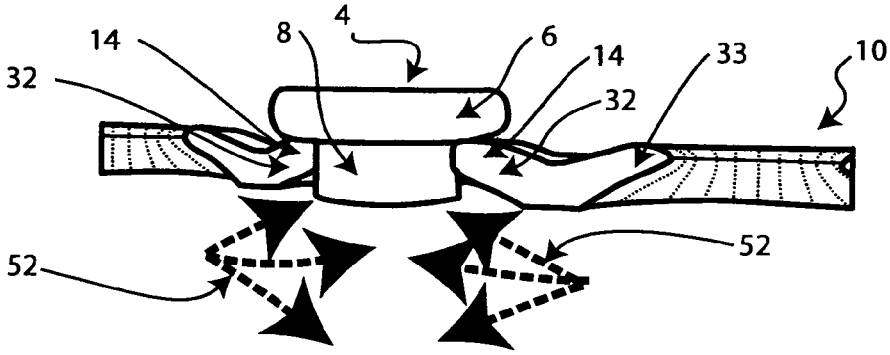
FIG 8

MULTI-USE ADJUSTABLE BELLOWS-SHAPED APERTURE STRAP

CROSS REFERENCES TO RELATED APPLICATIONS

This invention draws upon provisional application No. 60/996,560 filed Nov. 26, 2007.

STATEMENT REGARDING FEDERALLY SPONSORED RESEARCH OR DEVELOPMENT

This invention is not related to a federally sponsored research or development project.

THE NAMES OF THE PARTIES TO A JOINT RESEARCH AGREEMENT

This invention is not the output of a joint research action or agreement.

REFERENCES TO APPENDICES ON A COMPACT DISC AND AN INCORPORATION-BYREFERENCE OF THE MATERIAL ON THE COMPACT DISC

This application does not include compact discs or related files.

FIELD OF THE INVENTION

A multi-use adjustable bellows-shaped aperture strap for use in securing the heel of a user to an open-heeled swim fin using a mounting system (boss button and boss post). These multi-use adjustable tapered aperture straps have alternative embodiments for other diving or swimming equipment or appliances such as masks, goggles and the like having a seat adapted to be engaged by or onto a part of the user's body (foot-face). Further alternative embodiments use said multi-use adjustable tapered aperture straps for securing gear. Still further embodiments use the multi-use adjustable bellows-shaped aperture strap as an elastic belt for divers. The multi-use adjustable bellows-shaped aperture strap is comprised of an elongated multi-use adjustable bellows-shaped aperture strap body with an aperture system (a series of bellows-shaped aperture assemblies comprising tapered apertures connecting to raised arches) creating a bellows shaped form, asymmetrical top and bottom sides, and a first end tab and a second end tab additionally with tab center pulls preferably (although they are optional).

BACKGROUND OF THE INVENTION

Swimming is more efficient for people when swim fins are used and swimming and diving have developed into sports, occupations, and also as a military activity. Devices have been developed through the years to improve the use of swim fins. Swim fins are an effective device for improving a user's speed and power in traveling through the water. Open heeled fins are predominantly used by high end user's within the dive community, and for top level snorkeling and swimming with fins.

One major advantage of the open heeled fin is that it is more adjustable than other fins by the means of a heel strap that usually incorporates the use of one or two buckles to adjust it because the strap is usually not very elastic. Since the strap must withstand serious pressures that might tear about softer more flexible materials when used in a more elastic strap.

Open heeled fins are propelled by means of a variety of blade embodiments independent of the heel strap and they allow the user to more easily wear protective foot gear, booties. These booties allow the use of the fins in colder water with booties comprising thicker insulation or in warmer water with thinner booties.

Most of these fins use a boss comprising a boss button and boss post integrally affixed on the outer surface of either side of the foot pocket. The heel strap is generally held in place by a buckling mechanism (or in alternative embodiments stainless steel springs or elastic fibers may be held in place by respective securing plates). Beyond the strap's adjustability, the straps can be replaced if broken to keep the fin in service. Securing devices such as buckles or securing plates can damage the strap, spring or elastic fibers, and can also malfunction or break themselves rendering the fin inoperable.

Many complicated forms of straps, springs, elastic fibers, buckles and securing plates have been developed through the years by many different inventors. Past inventions in the prior art are clearly and substantially disclosed by U.S. Pat. No. 6,923,697 of Wagner. U.S. Pat. No. 6,923,697 of Wagner is the closest prior art to the present invention, and relates directly to open heeled swim fins with a heel strap secured to both sides of the foot pocket, and relates more particularly to orifices cut directly through the strap with end tabs appropriately sized so that they can be uniquely secured within the orifice to form a loop. Said orifices may be secured over the boss button of a fin, but must also be of a substantially solid materially enough so as to not break during normal use and strong enough to withstand the pressure of the tab trying to pull back through the orifice when it is coupled to the orifice to form a loop. The elongation capability in our tests of the straps taught by Wagner allowed the strap to stretch to 134 percent of its original size which is typical for elastomeric straps in which the need to keep the strap from breaking exceeds the need for elasticity in the strap. With limited elongation properties and the desire to couple with the tab, the orifices when small enough to stay under the boss button are difficult to place over the boss button. When the orifices are large enough to easily pass over the boss button, they are then large enough to easily ride back off the boss button during normal use. The device taught by Wagner does not incorporate any of the unique features of the multi-use adjustable bellows-shaped aperture strap, but concentrates on orifices and tabs that can form loops when coupled.

Additionally, other prior art swimming strap structures do not offer adequate elongation properties to allow for the changes in the dimensions of various boss posts and boss buttons. If the buckle, securing plate, or strap with orifices has holes that are too small to pass over the boss button or boss post, the buckle, securing plate or strap may not work properly. If the securing plate, the buckle or orifice taught by Wagner is too large, the strap may come off the boss during normal use, during storage or when the fin is in transit. Under many conditions, this is inconvenient and it is always undesirable. The boss post and boss button have fixed diameters, and if the securing holes for the buckles, securing plates and straps have fixed diameters or diameters with little elongation capabilities, they offer a problem in that they may not match and seat together properly with the boss buttons and boss posts.

Additionally, straps that are used generally in securing the heel, or securing the head of the user or securing the gear of the user, or as an elastic belt for the use must be substantially of a material that will not break under normal use in order to handle the stresses placed on it by normal use in diving and swimming and when on a boat. At present, these stronger materials do not lend themselves to substantial elongation. A strap elongation of 150 percent increase in its elongation size is considered excellent. Typical strap elongations of 135 percent of their original size are normally found. This limited elongation capability limits the effective use of such straps for heel straps, for straps to help hold on goggles, or masks, and for straps that are used for securing gear on the diver, swimmer or on a boat or as an elastic belt for the diver or swimmer.

SUMMARY OF THE INVENTION

The object of the present invention is to overcome the above drawbacks, and namely to provide an improved multi-use adjustable bellows-shaped aperture strap of the above-referenced type whose aperture assemblies (comprising tapered apertures and raised arches) combine to form an aperture system that allows unexpected elongation of the elastomeric material while maintaining structural integrity and strength. Through the deformation of the bellows-shaped structure of the aperture assembly, the aperture assembly elongates substantially 280 percent of its original length in our testing while maintaining higher than normal integral strength to help keep the strap from breaking. The number of aperture assemblies in the aperture system therefore affects the overall elongation capabilities of the strap with a higher number of assemblies contributing to a greater elongation potential. Being a simple strap to manufacture and with no need of buckles or securing plates, the multi-use adjustable bellows-shaped aperture strap is a simple elastomeric device with unexpected elongation properties that can be made from a variety of thermo-plastic elastomers, rubber compounds, urethanes, or other flexible rubber-like materials while conforming in its production to a variety of conventional-forms of manufacturing like injection molding or a casting process. The asymmetry of the aperture assembly from the bottom side of the multi-use adjustable bellows-shaped aperture strap to the top side of the multi-use adjustable bellows-shaped aperture strap has an unexpected bellows-effect in allowing the material to elongate like the bellows of an accordion through the deformation of said aperture assemblies in the aperture system. The aperture assembly deforms and spreads the tension forces in multiple-directions and in multiple-dimensions instead of the more normal linear mono-direction running along the elongated axis of the material, the strap thus has a greater flex and modulus than is found in prior art using similar elastomeric materials and more particularly in straps as taught by Wagner.

These improved multi-use adjustable tapered aperture straps adjust to serve a larger number of people through their increased elongation capabilities. In our tests, a multi-use adjustable bellows-shaped aperture strap was tested against an almost identical strap that was made with the same overall dimensions, same material, but with simple straight-through-the-strap orifices (as taught by Wagner and as found in other prior art straps) instead of the bellows-shaped aperture assembly. When tested, the difference between their elongation capabilities was substantial in that the multi-use adjustable bellows-shaped aperture strap had 3 times more elongation than its counterpart with simple straight-through-the-strap orifices as taught by Wagner. The simple straight-through-the-strap orifice version had a 37 percent stretch increase from its original size and the multi-use adjustable bellows-shaped aperture strap had a 111 percent increase from its original size. Considering that both straps had the same dimensions, had the same number of orifices/apertures of the same basic size, and were made of the same material at the same factory using an identical manufacturing process, the elongation difference is remarkable due to the bellows-shaped aperture assemblies. Since prior art straps as taught by Wagner and of this nature tested with an elongation of substantially 133 percent of their original size and since the strap of the present invention tested with an elongation of 211 percent of its original size, the elongation increased from 33 percent in prior art straps to 111 percent in straps of the present invention above their original respective sizes.

This increase in the elongation of the multi-use adjustable bellows-shaped aperture strap allows the user to stretch it further if desired to encompass larger shapes and allows for a broader range of adjustment as needed by the user for the amount of desirable tension on the strap. In the preferred embodiment, the multi-use adjustable bellows-shaped aperture strap will have center tabs near the heel to help pull the strap on and off the user, but in alternative embodiments the multi-use adjustable bellows-shaped aperture strap could have a seated area near the center of the strap for the back of the head of the user. In still another alternative embodiment of the multi-use adjustable bellows-shaped aperture strap, there may be no center tabs at all when used predominantly for securing gear or when used as a an elastic belt for a diver.

The bellows shaped aperture assemblies running the majority of the length of the strap can be likened to the bellows section of an accordion. The number of aperture assemblies (tapered apertures and raised arches) used in the aperture system dramatically affect the overall flex and modulus of the device. Even though the materials used in the bellows of an accordion are substantially solid, the geometric shape of the bellows section allows the materials to move in concert to allow the elongation of the bellows section and then the contraction of said section. Within the simplicity of this unique device, the tapered nature of the tapered apertures in a series on a first side of the strap run through the strap to a series of respectively much smaller apertures on a second side of the strap creating a series of multiple bellow shapes apertures within the structure of the strap to allow a relatively solid elastomeric material to elongate with unexpected ability. The tapered apertures are preferred in a conical form, but may be in a number of different geometric forms to include rectangular, star, spherical, triangular and elliptical forms. The same variety of shapes can be used with the raised arch section of the aperture assembly.

A further object of the present invention is to provide an improved multi-use adjustable bellows-shaped aperture strap of the above-referenced type whose compliant geometric construction allows unexpected superior flexibility of the elastic material of the strap without jeopardizing the strap's structural integrity because the geometric construction spreads the forces in a diverse non-linear manner through unique deformation of the aperture assembly which enable superior elongation of the strap and allows for a wider range of adjustment in the tension on the user's heel.

Another object of the invention is to provide a multi-use adjustable bellows-shaped aperture strap as a device that can be manufactured easily as a single unit with no additional parts and can be vacuum-wrapped on small display cards with the manufacturing materials substantially made from elastromeric rubbers or a variety of thermo-plastic elastomers, urethanes, or other flexible rubber-like materials conforming to a variety of conventional forms of manufacturing.

A further object of the invention is to provide an improved multi-use adjustable bellows-shaped aperture strap of the above-referenced type which, can in the tapered aperture bottom side of the strap, have a number of different geometric shapes, rectangular, spherical, elliptical or triangular as long as the tapered aperture is substantially larger than the boss button in use thereof, and that the aperture of the raised arch is substantially smaller and closer to the size of the boss post so that raised arch goes into compression under when stressed in normal use to strengthen and secure its position under the boss button.

Another further object of the invention is to provide an improved multi-use adjustable bellows-shaped aperture strap in which the larger size of the aperture of the tapered aperture allows the aperture assembly to pass over the button boss while the smaller size of the aperture of the raised arch keeps the strap securely tightened against the boss button post for a wide range of boss button and boss post dimensions respectively.

These and further objects are achieved according to the invention, but virtue of the fact that an improved adjustable strap for diving and swimming equipment of the type set-forth at the beginning is primarily characterized in that it is formed by two distinct aperture elements, the tapered aperture and the raised arch, forming the aperture assembly, each of which is connected to each other from their respective sides of the strap. Accordingly, said strap has asymmetrical top and bottom sides, said bottom side and said top side that are connected through the aperture system.

In an alternative embodiment, the raised arch may comprise an arch that reduces the aperture smaller than the smallest aperture of the tapered aperture but positioned as to not be raised above height of the body of the strap instead of standing above the body of the strap as in the preferred embodiment.

According to the preferred embodiment of the invention, end tab pulls are located at the distal ends of the strap to allow the user an easier grip in which to pull the strap to stretch it along its longer axis and in alternative embodiments have end anchor tab assemblies in which to secure themselves into the aperture assembly. Preferably the strap also has dual center opposing tab pulls, alternative embodiments may have the end anchor tab assemblies with no opposing center pull tabs.

The ends of all the prior-art straps are not adapted to pass through an orifice in the strap and secure itself thereat with the exception of Wagner. Only Wagner's strap has the structure and features for this purpose. However, the ends of Wagner are not useable on the aperture assemblies as taught in the present invention. Because of the outstanding flex and modulus produced by the bellows-shaped aperture assembly, the end taught by Wagner would simply pull back through. Without the extra catching ability of the end anchor tab assembly being larger and encompassing the width of the strap, the end of the strap would pull through the aperture assembly. Only the applicant's end anchor tab assembly has the structure and features for this purpose.

Alternatively embodiments may have a single center pull tab or dual tabs that are angled away from the heel of the user or may have a ring shaped pull to assist in putting on or taking off the dive fins or other swim related equipment. Similar ring pull tabs or angled pull tabs may be located at the distal ends of each side of the improved strap. Additionally, alternative embodiments can be made of different colors and can have padded shapes to diffuse the pressure of the strap on the head or heel of the user. In further alternative embodiments, the present device may have no center pulls.

The improved adjustable strap and additional embodiments endeavor to eliminate the use of the common buckling system of length adjustment and to create a device in its most simple state, a device with unexpected elastromeric qualities due to its bellows shaped aperture system enabling the use of wider range of adjustment, a device that attaches to the fin mounting system or other swim apparatus mounting systems easily because of the wide aperture of the tapered aperture, a device that remains more successfully connected to the mounting system during normal use because of the reduce size of the raised arch aperture, and a device that offers the convenience of being a spare to many fins on the market today. The strap according to the invention is applicable in a particularly advantageous way to open heel diving fins, but can be equally usefully employed in the case of other diving and swimming equipment, such as masks and goggles, such as elastic storage straps, or as securing straps or belts.

Several objects of this invention include, but are not limited to:

a. Supply the market with high quality improved multi-use adjustable tapered aperture straps with bellows-effect aperture system for use as dive fin straps.

b. Supply the market with high quality improved multi-use adjustable tapered aperture straps with bellows-effect aperture system for use in swimming equipment such as goggles or masks.

c. Supply the market with high quality improved multi-use adjustable tapered aperture straps with bellows-effect aperture system for use in stowing equipment using an integrated means of attachment at the distal ends of the strap.

d. Supply the market with high quality improved multi-use adjustable tapered aperture straps with bellows-effect aperture system for use in stowing equipment using a secondary means of attachment at the distal ends of the strap.

e. Create a multi-use adjustable bellows-shaped aperture strap with bellows-effect aperture system that can be used for either the right foot or left foot in diving interchangeably.

f. Create a multi-use adjustable bellows-shaped aperture strap with bellows-effect aperture system that can be used for either for a mask or goggles interchangeably.

g. Create a multi-use adjustable bellows-shaped aperture strap with bellows-effect aperture system that allows users to more easily adjust their straps with less effort and with more control through the use of compliant geometry allowing heavy duty elastic materials to stretch with less effort while maintaining structural integrity and reliability.

h. Create a multi-use adjustable bellows-shaped aperture strap with bellows-effect aperture system that allows users to secure the strap onto a boss or mounting system with greater ease.

i. Create a multi-use adjustable bellows-shaped aperture strap with bellows-effect aperture system that allows users more latitude in the angle of pulling that the strap can be drawn without dislodging it from the mounting system.

j. Create a multi-use adjustable bellows-shaped aperture strap with bellows-effect aperture system with bellows-effect aperture system that uses compression to spread the load when under stress so as to better resist tearing and so as to maintain a better secure position when used.

k. Create a multi-use adjustable bellows-shaped aperture strap with bellows-effect aperture system that can be removed easily when desired, but remains secure attached during normal use.

l. Create a multi-use adjustable bellows-shaped aperture strap with bellows-effect aperture system for many different diving and swimming uses that does not use a buckle system.

m. Create a multi-use adjustable bellows-shaped aperture strap with bellows-effect aperture system that can easily be made in many bright colors and varying shapes.

n. Create a multi-use adjustable bellows-shaped aperture strap with bellows-effect aperture system that alternatively can function in the same manner as a fixed-heel strap style of fin.

o. Create a multi-use adjustable bellows-shaped aperture strap with bellows-effect aperture system that can more easily adjust to the users needs for both cold water or warm water use by being more flexible through the use of compliant geometry and allowing a wider range of sizes of users to use a wider range of boots.

p. Create a multi-use adjustable bellows-shaped aperture strap with bellows-effect aperture system that attaches to boss buttons on a shoe for easy adjustment to loosen or tighten the fit for the user as needed for multiple uses.

q. Provide a multi-use adjustable tapered aperture strap (an elastomeric strap) with bellows-effect aperture system that does not involve buckles and therefore facilitates easier replacement.

The present invention accomplishes these desired objects by providing a new an improved multi-use adjustable bellows-shaped aperture strap that will fit a variety of diving and swimming equipment, has no buckles, has greater stretching ability through the use of compliant geometry from the aperture system of the strap comprising bellows-shaped aperture assemblies and is therefore more adjustable and more easily attached—

While remaining more securely attached to the mounting system of the fin through the compression of the raised arch when under normal stress. The invention will now be disclosed in detail with reference to the accompanying drawings, related to application of the improved strap, wherein:

BRIEF DESCRIPTION OF THE DRAWINGS

The accompanying drawings, which are incorporated in and form a part of this specification, illustrate embodiments of the invention and together with the description, serve to explain the principals of the invention.

FIG. 4 depicts a perspective view of the cut away of FIG. 2 in which the cut away drawing allows the merging of the tapered aperture into the raised arch to be seen better forming the aperture system.

FIG. 5 depicts a perspective view of the cut away of FIG. 2 with the mounting assembly of the swim fin in relation to the aperture system of the strap.

FIG. 6 is a side elevation depiction of the cut away view of FIG. 2 with the mounting boss of the swim fin pushing top against the aperture system and arrows representing the vector forces created in the aperture system by the boss button element of the mounting system. (Part list: 48 arrows showing top vector forces exerted on the aperture assembly when the mounting system is pushed from the bottom side towards the top side of the strap.)

FIG. 7 is a side elevation depiction of the cut away of FIG. 2 with the aperture system secured by the boss button of the mounting system with dotted arrows showing vector forces exerted down onto the aperture system by the boss button. (Part list: 50 dotted line arrows showing down vector forces of compression on the raised arch.)

FIG. 8 depicts a perspective view of the cut away view of FIG. 2 with the aperture system secured by the boss button of the mounting system with dashed arrows showing the bulging vector force on the aperture system from the mounting system. (Part list: 52 dashed line arrows showing the bulging vector forces causing the aperture system to bulge when surrounding the mounting system.)

DETAILED DESCRIPTION OF THE INVENTION

Figure 1:
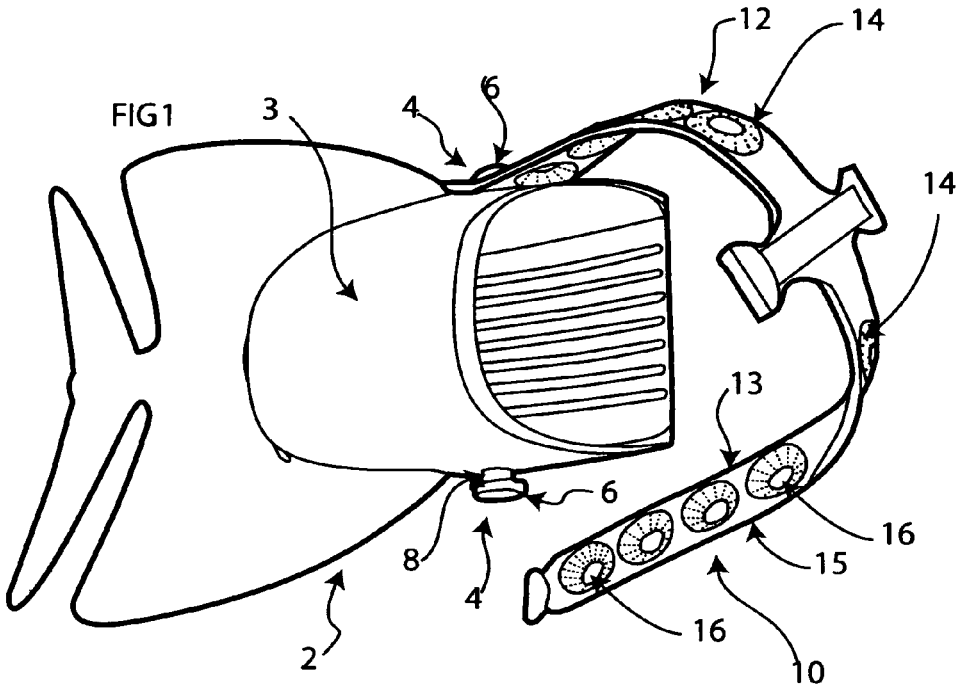
FIG. 1 depicts a perspective view of an open heeled swim fin with a standard mounting system and a strap attached to the mounting system on one side of the fin. (Parts list: 2 open heeled swim fin; 3 foot pocket of said open heeled swim fin; 4 mounting system; 6 boss button; 8 boss post; 10 an improved strap.)

It is well known that open heeled swim fins 2 have a foot pocket 3 with a mounting system 4 laterally mounted on opposing sides of said foot pocket 3. Said mounting system 4 comprises a boss button 6 and a boss post 8. The improved adjustable strap 10 is often used in securing the heel of a user to an open-heeled swim fin 2 with a mounting system 4.

The strap 10 is described in detail in the following paragraphs and with particular reference to the drawings. It should be understood the strap 10 is usable with any open-heeled swim fin 2 having a foot pocket 3 and a mounting system 4 in which the foot pocket can receive a forward part of the foot regardless of the swim fin's propulsion blade design. The foot of the user is normally covered by a protective bootie (well known within the art but not shown in FIG. 1), though there are water conditions where the bootie is not required and can be omitted. This strap 10 has alternative embodiments for other diving or swimming equipment or appliances such as masks, goggles and the like having a seat adapted to be engaged by or onto a part of the user's body (foot-face) to be discussed later. With reference to FIG. 1, the heel strap 10 of the invention is attached to an open heel swim fin 2 only the right side of the foot pocket 3. The strap 10 hangs free on the left side of the foot pocket 3 near the mounting system 4.

Figure 2:
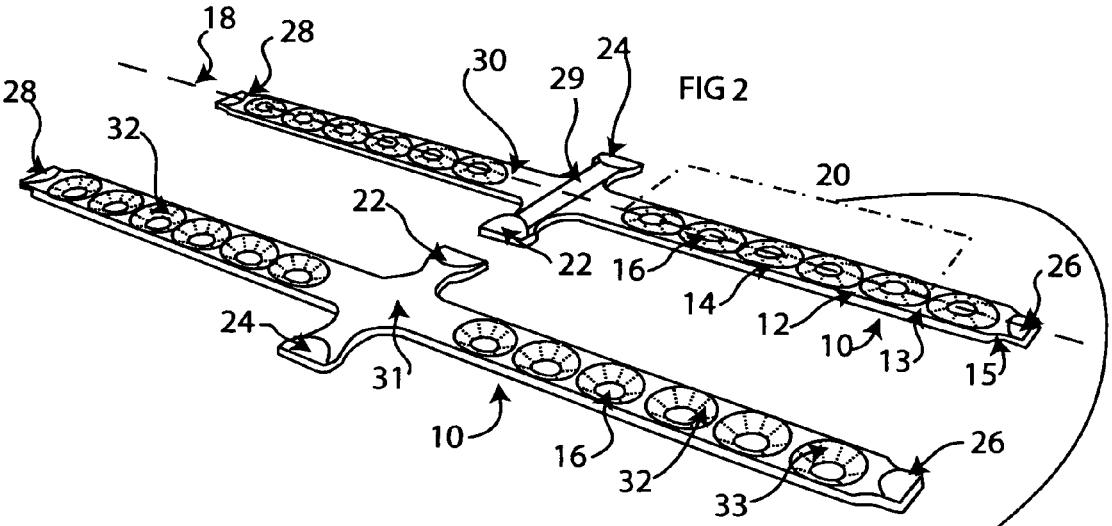
FIG. 2 is a perspective view of two sides of the preferred embodiment of the present invention with the first view showing the bottom side (side A), the tapered aperture side of the strap, and a second view (side B) showing the top side, the raised arch side of the strap. (Parts list: 12 elongated strap body; 13 first side of the strap body; 14 raised arch; 15 second side of the strap body; 16 reduced diameter aperture; 18 dashed line denoting the center line of the elongated aspect of the strap body; 20 small dashed line denoting cut away section of strap extending to the center line; 22 first center tab pull; 24 second center tab pull; 26 first end tab at one distal end of the elongated strap; 28 second end tab at the other distal end of the elongated strap; 29 raised center support on the; 30 top side of the strap body; 31 taper of the aperture; 32 the tapered aperture on the; 33 aperture assembly comprising said tapered aperture and raised arch; 34 bottom side of the strap body.)

As best seen in FIG. 2, the strap 10 is a one piece article with an elongated strap body 12 employing a unique raised arch 14 with a reduced diameter aperture 16 to better close around said aforementioned boss post 8. By having a reduced diameter aperture 16 that is approximately the same diameter as the boss post 8 or slightly smaller, the smaller aperture 16 closes around the boss button 6 of the mounting system 4 and is held there by elastic tension. This also allows for a number of various boss post 8 diameters to be serviced without inhibiting the ability of the raised aperture 14 from passing over the larger boss button 6. The dashed line denoting the center line 18 of the elongated strap body 12 is intersected by a small dashed line 20 to denote a cut away section of the strap 10 to be better described in FIG. 3. The first center tab pull 22 is opposite the second center tab pull 24 in the center of said strap 10. Said center tab pulls are used for pulling the strap onto and off of the user. In other alternative embodiments, these tabs may be have the shape of a ring, or angled tab (not shown here but well known in the art and may have only one tab or no tabs instead of the two tabs as shown in the preferred embodiment in FIG. 1.) The first end tab 26 at one distal end of the elongated strap, and the second end tab 28 at the opposing end of the elongated strap 10 help the user pull the strap 10 over the boss button 6 both for coupling the strap 10 to the mounting system 4 of the fin 2 and for uncoupling the strap 10 as needed.

A raised center support 29 runs between the center tab pulls 24 and 26 respectively to give the strap 10 strength when being pulled on and off of the user. This center support 29 is only located on the top side 30 of the strap 10. The opposing side of the strap, the bottom side 31, shares the center tab pulls 22 and 24, and end tabs 26 and 28. The bottom side 31 also has the novel elements of tapered apertures 32 which merge into the raised arches 14 to form the aperture assembly 33.

Figure 3:
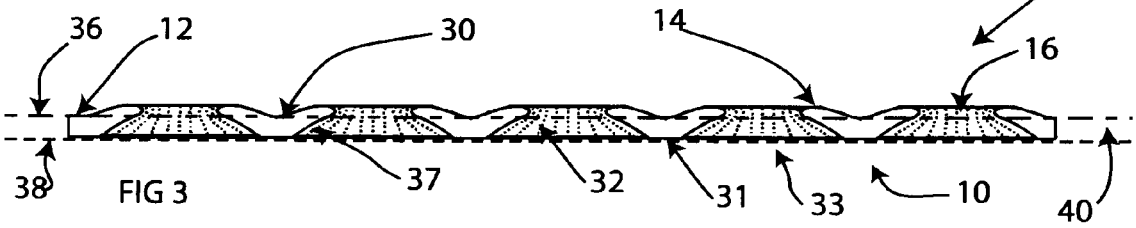
FIG. 3 is a side elevation depiction of the call out drawing from said cut away section of FIG. 2. (Parts list: 36 dotted line showing upper level of the top side of the strap; 38 dotted line showing the limit of the bottom side of the strap; 40 is the thickness of the strap between the top side and the bottom side, not including the raised arch.)

In the preferred embodiment illustrated by the cut away drawing of FIG. 3, the aperture assembly 33 is shown merging its component parts, the tapered aperture 32 and the raised arch 14. These two respective parts of the aperture assembly 33 form a bellows like shape that allows the strap 10 to stretch further without breaking than would otherwise be expected. The dotted line 36 shows the level of the top side 30 of the strap body 12 and is located above the dotted line 38 showing the level of the bottom side of the strap body 12. Together they help to define the height 40 of the body of the strap 12. As can be seen in this illustration, the raised arch 14 rises above the body of the strap 12 in this preferred embodiment. This does not preclude possible alternative embodiments in which the raised arch 14 does not rise above the dotted line 30 and remains within the height 40 of the body of the strap 12.

The perspective drawing of FIG. 4 helps to illustrate the wavy up and down nature of the aperture system 42 which comprises the series of aperture assemblies 33 of said strap 10. When stretched, the raised arch 14 lowers itself near or below the dotted line 36 denoting the top level of the body of the strap 12. The tapered apertures 32 work together with the raised arch 14 to allow the strap 10 to stretch further thus offering more adjustment possibilities to the user. This accordion bellows effect causes a compliant geometry in the strap 10 that offers more material for the user to stretch without placing any particular part of the strap under undue stress to where it would break in normal use. Please note that even further undulation in both the raised arch and the tapered aperture or an increase in the number of the aperture assemblies 33 would offer even more material for stretching without over burdening the established elasticity of the material used for the strap and could be found in alternative embodiments.

With the introduction of the mounting system 4 in FIG. 5, the second major reason for having this particular form of aperture assembly is shown. As the boss button 6 seats against the tapered aperture 32, the larger size of the bottom side 31 of the strap 10 is larger than the largest boss button commonly known in the art. The extra larger diameter of this part of the tapered aperture 32 helps to center the boss button 6 in the tapered aperture 32. The aperture assembly 33 has a larger diameter aperture in this portion of the tapered aperture 32 but has a reduced aperture 16 that has a possibly smaller diameter than the boss post 8 or is substantially the same.

Because the raised arch 14 is unsupported by the strap body 12 as illustrated in FIG. 6, the solid line arrows 48 show the top vector forces exerted on the aperture assembly 33 when pushed by the boss button 6. The forces on the aperture assembly 33 are multi-dimensional and multi-directional when the strap 10 is stretched because the support for the strap shifts horizontally, vertically and from sides to side instead of being a linear set of forces as would be found on a rope as they are in normal strap construction. In addition to allowing the material to have a greater flex and modulus, the aperture assemblies also allow the boss button 6 to penetrate the aperture assembly 33 more easily.

After the boss button 6 has penetrated the reduced aperture 16 of the aperture assembly 33 as is illustrated in FIG. 7, the raised arch 14 reduces in size conforming to the size of the boss post 8 and being put under compression by the boss button 6. Now the forces from the boss button 6 are pushing down on the aperture assembly 33 and in particular on the raised arch 14 of the strap 10 to form down vector forces 50 shown as dotted line arrows. This places the raised arch 14 under compression which helps to it to stay coupled with the mounting system 4 when under normal use.

A certain amount of bulging takes place in the aperture system 33 and is illustrated in FIG. 8 by dashed arrows 52 representing these bulging vector forces. These bulging vector forces 52 help to spread the raised arch 14 of the aperture assembly 33 to help spread the load when under stress from normal use. This assists in keeping the strap 10 coupled to the mounting system 4 even when the strap is pulled at an angle that is up to forty-five degrees from the line presented by the boss post 8. By spreading the load, the incidence of tearing the strap 10 is also reduced to make the strap 10 more reliable while allowing unusually large elasticity to aid the user in adjusting strap size and pressure.

Figure 9:
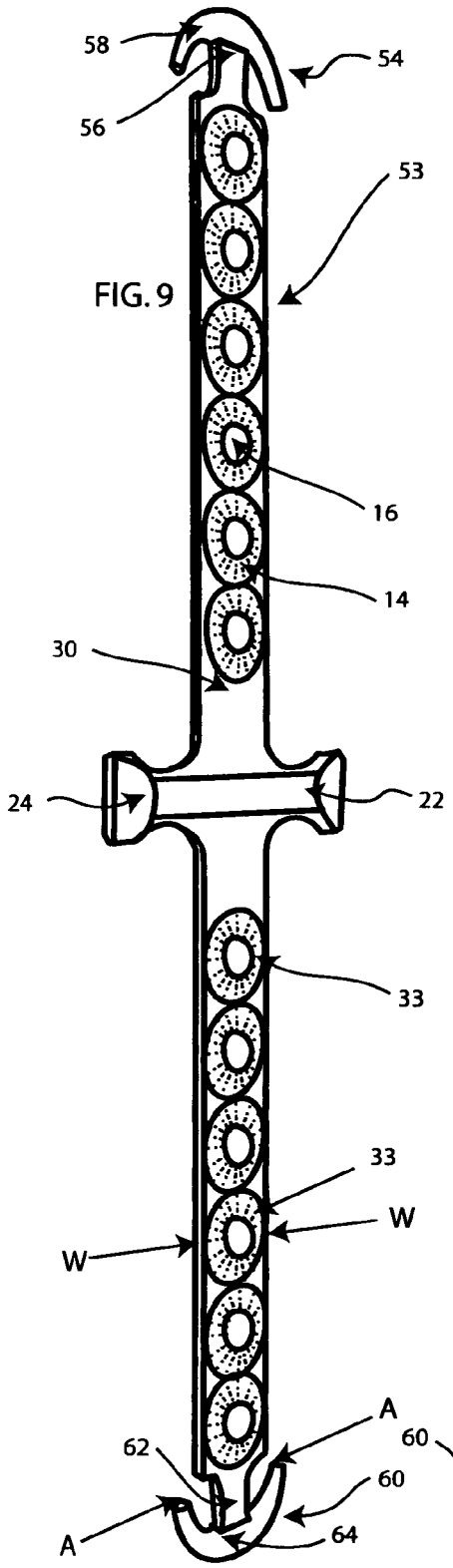
FIG. 9 is a side perspective view of an alternative embodiment of the strap with anchor tab assemblies comprising anchors and tangs. (Parts list: 53 alternative embodiment strap; 54 second end anchor tab assembly; 56 second end tang; 58 second end anchor; 60 first end anchor tab assembly; 62 first end tang; 64 first end anchor.)

An alternative embodiment of the strap 53 is illustrated by FIG. 9 with a second end anchor tab assembly 54 comprising a second end tang 56 and a second end anchor. On the opposing distal end of the strap 10 is the first end anchor tab assembly 60 comprising the first end tang 62 and the first end anchor 64. The unexpected elastic quality of the aperture assembly 33 portion of the strap 53 allows the second end anchor 58 to be pulled through any aperture assembly 33 of the strap 53 until the entire anchor 58 extends through the aperture assembly 33 which then surrounds the second end tang 56. Because of the unexpected elasticity of the aperture assembly 33 an anchor shaped end is necessary to trap the edges of the strap 10 to help keep the second end anchor 58 trapped by the aperture assembly. The end tabs taught by prior art are not of a sufficient size or shape to perform this function. The width A of the first and second end anchors, 64 and 58 respectively, must be greater than the width W of the body of the strap 53. The larger width A of the anchors 64 and 58 help to ensure that the anchors will not inadvertently pass back through the aperture assembly 33.

Figure 10:
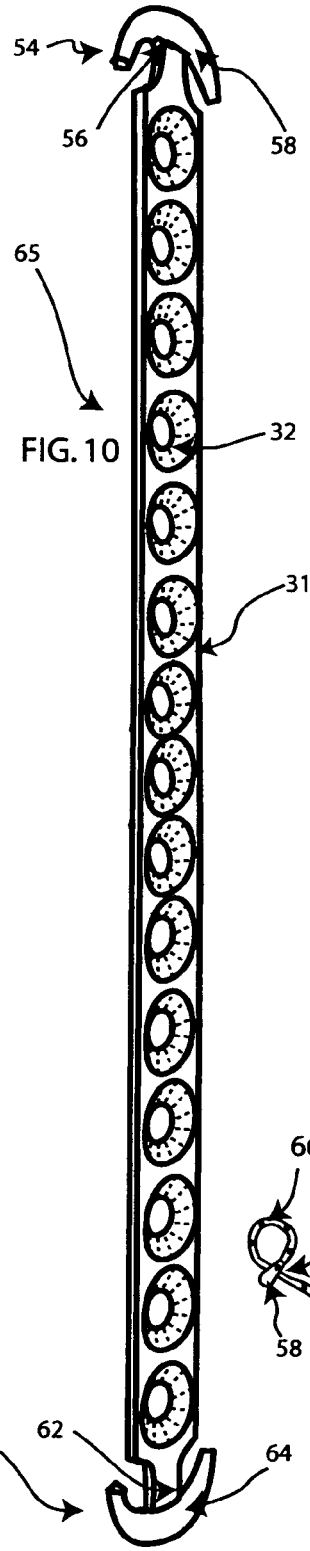
FIG. 10 is a side perspective view of another alternative embodiment of the strap with anchor tab assemblies comprising anchors and tangs with extra aperture assemblies 33 in the strap 10 using no center tab pulls. (Part list: alternative no-center-tabs embodiment strap 65.)

The alternative embodiment strap 53 of FIG. 9 becomes an alternative no-center-tabs embodiment strap 65 as shown in a perspective view in FIG. 10. The down side 32 of the strap 65 is seen and the major difference between strap 53 and 65 is the absence of center tabs 22 and 24 in said strap 65 along three additional aperture assemblies 33 located in the center of the strap 65. The additional aperture assemblies 33 enable said strap 65 to elongate to a longer length than strap 53. The strap 65 would be more likely used for securing gear only instead of the preferred strap 10 which is more likely used for securing the heel of a user into a fin 2.

Figure 11:
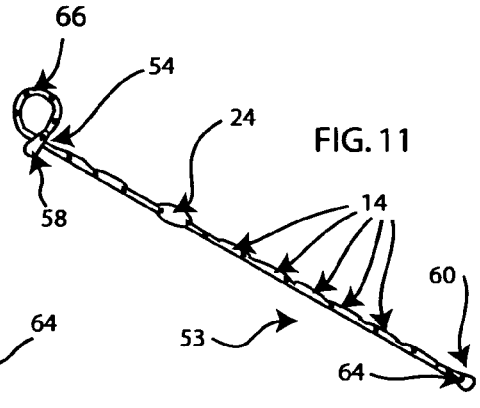
FIG. 11 is a plan view of the strap of FIG. 9 in which the second end anchor tab assembly has passed through the aperture assembly of the alternative embodiment of the strap to form a loop. (Part list: 66 loop.)

FIG. 11 is the plan view of the strap 53 of FIG. 9 in which the second end anchor 58 of said second end anchor tab assembly 54 has passed through the aperture assembly marked by the lines and W's and is overlapping the strap 53 while forming the loop 60. In addition to being able to form a loop 60, the anchors 58 and 64 can pass through any appropriately sized aperture assembly 33 of any strap 10 or 53 or 65 or like straps to chain the straps 10 and/or 53 and/or 65 together for use in storing gear for example.

Figure 12:
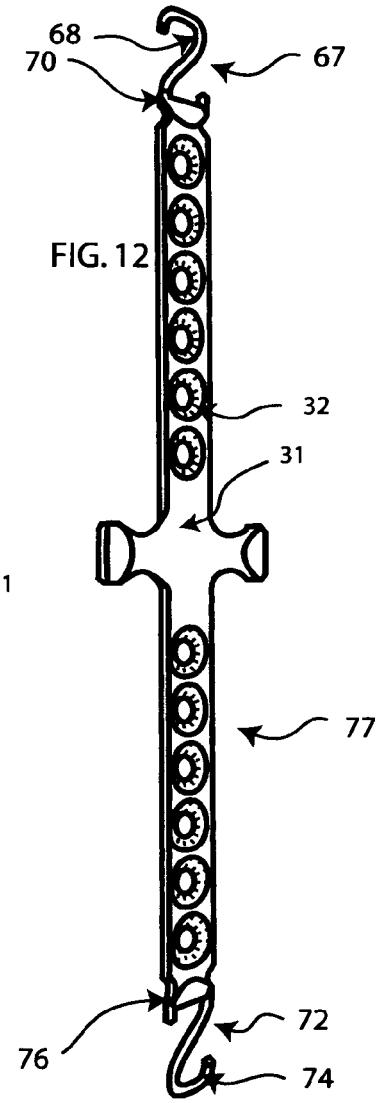
FIG. 12 is a side perspective view of an additional alternative embodiment of the strap with an attachment means. (Parts list: 67 second end attachment means; 68 second end "S" hook; 70 second end tab attachment; 72 first end attachment means; 74 first end "S" hook; 76 first end tab attachment; 77 alternative attachment means embodiment strap.)

As an alternative to the first and second end anchor tab assemblies 54 and 60, a first and second end attachment means may be used as found illustrated in FIG. 12 in a perspective drawing of an alternative attachment means embodiment strap 77. Strap 77 uses in this embodiment a second end attachment means comprising a second end "S" hook attached to the strap 77 at the second end tab attachment. On the opposite distal end of strap 77 is the first end attachment means 72 comprising a first end "S" hook attached to the strap 77 at the first end tab attachment 76. These "S" hooks 68 and 72 respectively can pass through any aperture assembly 33 to hook the aperture assembly 33 in such a manner as to form a loop (not shown in FIG. 12) in the strap 77. The "S" hooks 68 and 72 respectively can also hook onto each other to form a larger loop and to possibly chain other like straps together to secure larger gear on the diver or on a boat.

It must be made clear that any number, any geometric sizes or shapes of the tapered apertures, for the means of attachment, may be located along any portion of either end of the improved strap, and the strap may or may not have the same orifices symmetrically located on either end of the center tab pulls of the strap as well as the raised arch extending beyond the height of the body of the strap or being contained within in it and still be within the scope of this patent.

Having described the invention in the preferred embodiment, it should be clear that modifications can be made without departing from the spirit of the invention. It is not intended that the words used to describe the invention nor the drawings illustrating the same be limiting on the invention. It is intended that the invention only be limited by the scope of the claims.

LIST OF PARTS

2 open heeled swim fin; 3 foot pocket of said open heeled swim fin;

3 foot pocket;

4 mounting system;

6 boss button;

8 boss post;

10 an improved strap;

12 elongated strap body;

14 raised arch;

16 reduced diameter aperture;

18 dashed line denoting the center line of the elongated aspect of the strap body;

20 small dashed line denoting cut away section of strap extending to the center line;

22 first center tab pull;

24 second center tab pull;

26 first end tab at one distal end of the elongated strap;

28 second end tab at the other distal end of the elongated strap;

29 raised center support on the;

30 top side of the strap body;

32 the tapered aperture on the;

33 aperture assembly comprising said tapered aperture and raised arch;

34 bottom side of the strap body;

36 dotted line showing upper level of the top side of the strap;

38 dotted line showing the limit of the bottom side of the strap;

40 is the thickness of the body of the strap between the top side and the bottom side, not including the raised arch;

42 aperture system which comprises the series of aperture assemblies in the strap

48 solid line arrows showing top vector forces exerted on the aperture assembly when the mounting system is pushed from the bottom side towards the top side of the strap

50 dotted line arrows showing down vector forces of compression on the raised arch;

52 dashed line arrows showing the bulging vector forces causing the aperture system to bulge when surrounding the mounting system;

53 alternative embodiment strap

54 second end anchor tab assembly;

56 second end tang;

58 second end anchor;

60 first end anchor tab assembly;

62 first end tang;

64 first end anchor

65 alternative no-center-tabs embodiment strap

66 loop

67 second end attachment means;

68 second end "S" hook;

70 second end tab attachment;

72 first end attachment means;

74 first end "S" hook;

76 first end tab attachment;

77 alternative attachment means embodiment strap.

I claim:

1. An elastomeric strap with a plurality of spaced apertures, for selective releasable connection to a remote boss button, comprising:

a. an elastomeric strap with a first end and an opposing second end, a first side and a second side in spaced relation from the first side, a top surface and a bottom surface, the top and bottom surfaces spaced apart by a central section of elastomeric material;

b. a plurality of spaced apertures extending through the elastomeric material in spaced relation along the elastomeric strap, each aperture with an enlarged raised tapered lower surface to merge with a raised arch on the strap's top surface to provide a reduced cross sectional area which is less than the central section of the elastomeric material; and c. a remote boss button mounted to an adjoining part, the remote boss button with an enlarged top portion sized to be less than the width of the raised tapered lower surface of each aperture on the elastomeric strap, and a boss post sized to be of a smaller diameter than the enlarged top portion of the boss elastomeric strap, and the height of the boss post sized to be substantially the thickness of the central section of the elastomeric strap.

2. The elastomeric strap of claim 1, wherein each tapered aperture includes a boundary surface having a plurality of continuous three-dimensional segments selected from at least one of rectangular, round, oval, spherical, elliptical, triangular, multisided, and free form shapes.

3. The elastomeric strap of claim 1, further comprising a center pull tab located substantially midway between the first end and the second end of the elastomeric strap, the pull tab sized to extend beyond one of the first and second sides of the elastomeric strap.

4. The elastomeric strap of claim 1, further comprising a first end tab extending from one of the first and second ends of the elastomeric strap to comprise an anchor tab, and the anchor tab is bent to pass through one of the spaced apertures on the elastomeric strap, thus forming an engagement loop there between.

5. The elastomeric strap of claim 1, further comprising an "S" hook connected to one of the first and second ends of the elastomeric strap, for remote connections thereto.

6. The elastomeric strap of claim 1, wherein the selected elastomeric material is a thermostat material which requires sulfur vulcanization, such as natural rubber, and is preferably selected from thermoplastic elastomers selected from: TPE, TPV, TPU, and TPO.

7. The elastomeric strap of claim 1 wherein the remote boss buttons are mounted to a shoe and the elastomeric strap of claim 1 attaches to boss buttons on a shoe for easy adjustment to loosen or tighten the fit for the user as needed for multiple uses.

8. An elastomeric dive-fin heel-strap, comprising:

a. a heel strap having a first end and a second end spaced from the first end, a first side and a second side in spaced relation from the first side, an outer surface and an inner surface, the inner surface spaced apart from the outer surface by a center section of a selected elastomeric material thickness;

b. a plurality of spaced apertures extending between the outer surface and the inner surface of the heel-strap, each aperture on the inner surface comprising a raised tapered aperture extending towards the outer surface, to merge with a raised portion on the outer surface to produce a reduced cross-sectional area which is less than the thickness of the center section of the selected elastomeric material thickness, and c. a remote boss button mounted to an adjoining part, the remote boss button with an enlarged top portion sized to be less than the width of the raised tapered lower surface of each aperture on the top heel strap, and a boss post sized to be of smaller diameter than the enlarged top portion of the boss button, the boss post further sized to be closely received through the elected spaced aperture on the heel strap, and the height of the remote boss post sized to be substantially the thickness of the central section of the elastomeric heel strap.

9. An elastomeric strap with a plurality of spaced apertures for selective engagement with a remote boss button and boss post on an adjoining part, comprising:

a. an elastomeric strap with a first end, a second end opposite the first end, a first side and a second side in space relation from the first side, a top surface and a bottom surface, a center section extending between the top surface and bottom surface;

b. the spaced apertures each with a tapered portion extending from the bottom surface to merge with a raised arch with a reduced diameter aperture positioned above the top surface in spaced relation between the first side and the second side, and the tapered aperture on the bottom surface sized to be at least as large as the remote boss button, and the aperture is positioned on the raised top surface is substantially the size of the boss post; and c. a center pull tab is secured to the elastomeric strap substantially midway between the first end and the second end of the elastomeric strap.

10. The elastomeric strap of claim 9, wherein the selected elastomeric material is a thermostat material which requires sulfur vulcanization, such as natural rubber, and is preferably selected from the thermoplastic elastomers selected from: TPE, TPV, TPU and TPO.

11. The elastomeric strap of claim 9, wherein each tapered aperture includes a boundary surface having a plurality of continuous three-dimensional segments selected from at least one of: rectangular, round, oval, spherical, elliptical, triangular, multisided and free form shapes.

12. The elastomeric strap of claim 9, further comprising a first end tab extending from one of the first and second ends of the elastomeric strap to comprise an anchor tab which is wider than the width from the first side to the second side, and the anchor tab is bent to pass through one of the spaced apertures on the elastomeric strap, thus forming an engagement loop there-between.

13. The elastomeric strap of claim 9, wherein at least one of the first end and the second end of the elastomeric strap comprises an end tab.

14. The elastomeric strap of claim 9, further comprising an "S" hook connected to one of the first and second ends of the elastomeric strap, for remote connection thereto.

15. An elastomeric dive-fin heel-strap, comprising:

a. a heel strap having a first end and a second end spaced from the first end, a first side and a second side in spaced relation from the first side, an outer surface and an inner surface, the inner surface spaced apart from the outer surface by a center section of a selected elastomeric material thickness;

b. a plurality of spaced apertures extending between the outer surface and the inner surface of the heel-strap, each aperture on the inner surface comprising a raised tapered aperture extending towards the outer surface, to merge with a raised portion on the outer surface to produce a reduced cross-sectional area which is less than the center section of the selected elastomeric material thickness, the cross section of the bottom of the aperture is greater in cross-section than the cross-section at the top of the aperture; and c. a remote boss button mounted to an adjoining part, the remote boss button with an enlarged top portion sized to be less than the width of the raised tapered lower surface of each aperture on the hell strap, and a boss post to be sized to be of a smaller diameter than the enlarged top portion of the boss button, the boss post further sized to be closely received through the selected spaced aperture on the heel strap, and the height of the remote boss post sized to be substantially the thickness of the central section of the elastomeric strap.

16. The dive-fin heel-strap of claim 15, wherein the selected elastomeric material is a thermoset material which requires sulfur vulcanization, such as natural rubber, and is preferably selected from thermoplastic elastomers selected from: TPE, TPV, TPU, and TPO.

17. The dive-fin heel-strap of claim 15, wherein each tapered aperture includes a boundary surface having a plurality of continuous three-dimensional segments selected from at least one of rectangular, round, oval, spherical, elliptical, triangular, multisided, and free form shapes.

18. The dive-fin heel-strap of claim 15, further comprising a center pull tab located substantially midway between the first and the second end of the elastomeric strap, the pull tab sized to extend beyond on e of the first and second sides of the elastomeric strap.

19. The dive-fin heel-strap of claim 15, further comprising a first end tab extending from one of the first and second ends of the elastomeric strap to comprise an anchor tab, and the anchor tab is bent to pass through one of the spaced apertures on the elastomeric strap, thus forming an engagement loop there between.

20. The dive-fin heel-strap of claim 15, further comprising an end tab with an aperture to accept, hold and release a separate "S" hook, for remote connection thereto.

* * * * *